US008610522B2

(12) United States Patent
Deylitz et al.

(10) Patent No.: US 8,610,522 B2
(45) Date of Patent: Dec. 17, 2013

(54) ELECTRICAL SWITCH

(75) Inventors: Erhard Deylitz, Berlin (DE); Björn Gehrke, Berlin (DE); Pierre Lamoth, Berlin (DE); Mathias Schmidt, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/409,193

(22) Filed: Mar. 1, 2012

(65) Prior Publication Data

US 2012/0222945 A1 Sep. 6, 2012

(30) Foreign Application Priority Data

Mar. 2, 2011 (DE) ..... 10 2011 004 968

(51) Int. Cl.
*H01H 9/20* (2006.01)

(52) U.S. Cl.
USPC ..... 335/160

(58) Field of Classification Search
USPC ..... 335/160, 16; 361/607, 609, 615
See application file for complete search history.

(56) References Cited

U.S. PATENT DOCUMENTS

| | | | | | |
|---|---|---|---|---|---|
| 3,634,795 | A | * | 1/1972 | Schleicher | 335/170 |
| 3,915,273 | A | * | 10/1975 | Loschengruber | 192/135 |
| 4,849,590 | A | * | 7/1989 | Becker et al. | 218/33 |
| 4,945,450 | A | * | 7/1990 | Sabatella et al. | 361/624 |
| 5,164,695 | A | * | 11/1992 | Monson et al. | 335/202 |
| 5,172,300 | A | * | 12/1992 | Morby et al. | 361/637 |
| RE34,396 | E | * | 10/1993 | Wollenhaupt | 200/50.06 |
| 5,300,905 | A | * | 4/1994 | Kolbas et al. | 335/167 |
| 5,332,986 | A | * | 7/1994 | Wieloch | 335/78 |
| 5,334,808 | A | * | 8/1994 | Bur et al. | 200/50.21 |
| 5,508,670 | A | * | 4/1996 | Mantzouridis et al. | 335/172 |
| 5,623,135 | A | | 4/1997 | Hashimoto et al. | |
| 5,719,363 | A | * | 2/1998 | Handler | 200/50.02 |
| 6,076,384 | A | | 6/2000 | Thielmann et al. | |
| 6,137,068 | A | * | 10/2000 | Padulo | 200/43.16 |
| 6,388,859 | B1 | * | 5/2002 | Turner et al. | 361/115 |
| 6,388,868 | B1 | * | 5/2002 | Leccia et al. | 361/607 |
| 6,897,748 | B2 | * | 5/2005 | Yamagata et al. | 335/132 |
| 7,515,025 | B2 | * | 4/2009 | Mrowiec et al. | 335/167 |
| 7,541,900 | B2 | * | 6/2009 | Portier | 335/159 |
| 7,724,112 | B2 | * | 5/2010 | Kerr | 335/167 |

(Continued)

FOREIGN PATENT DOCUMENTS

| | | | |
|---|---|---|---|
| DE | 1 765 808 | A1 | 10/1971 |
| DE | 34 39 887 | A1 | 10/1985 |

(Continued)

OTHER PUBLICATIONS

German Priority document for German Application No. DE 10 2011 004 968.1 (Not Yet Published).

(Continued)

*Primary Examiner* — Alexander Talpalatski
(74) *Attorney, Agent, or Firm* — Harness, Dickey & Pierce, P.L.C.

(57) ABSTRACT

An electrical switch is disclosed for switching an electric current, the switch being suitable for being inserted into a switch holding device. In at least one embodiment, the switch includes a locking device which, in the event of an overcurrent, moves a locking element of the locking device to a position which mechanically locks the switch in the switch holding device.

12 Claims, 4 Drawing Sheets

(56) References Cited

U.S. PATENT DOCUMENTS

| | | | | |
|---|---|---|---|---|
| 8,183,964 | B2 * | 5/2012 | Mrowiec et al. | 335/167 |
| 2003/0001702 | A1 | 1/2003 | Bach et al. | |
| 2006/0037846 | A1 | 2/2006 | Deylitz et al. | |
| 2008/0012665 | A1 * | 1/2008 | DeBoer et al. | 335/16 |

FOREIGN PATENT DOCUMENTS

| | | | |
|---|---|---|---|
| DE | 93 06 309 | U1 | 6/1993 |
| DE | 197 06 019 | A1 | 8/1998 |
| DE | 198 08 271 | C1 | 9/1999 |
| DE | 102 50 214 | B3 | 8/2004 |
| JP | 3235604 | A | 10/1991 |
| JP | 10032904 | A | 2/1998 |
| JP | 2000037007 | A | 2/2000 |
| WO | WO 01/57979 | A1 | 8/2001 |

OTHER PUBLICATIONS

Abstract of WIPO Patent Publication No. WO 2004040726.
Abstract of French Patent Publication No. FR 2775543.

* cited by examiner

ELECTRICAL SWITCH

PRIORITY STATEMENT

The present application hereby claims priority under 35 U.S.C. §119 to German patent application number DE 10 2011 004 968.1 filed Mar. 2, 2011, the entire contents of which are hereby incorporated herein by reference.

FIELD

At least one embodiment of the invention generally relates to an electrical switch, in particular a circuit breaker, for switching an electric current, with the switch being suitable for being inserted into a switch holding device.

BACKGROUND

As is known, switches, for example circuit breakers, are mounted in suitable switch holding devices which may, for example, be racks. By way of example, switches may be inserted into racks such as these by "cranking them in", and, by way of example, the switches can be removed from the racks by "cranking them out".

Overcurrent situations can occur during operation of the switches within the racks, for example in the event of a short. In the event of an overcurrent, relatively large magnetic forces occur, which act mechanically on the switch located in the rack, and attempt to move the switch forward out of the rack. Even if the movement distance is only short, such outward movement of the switches can break the contact between the switch and the rack, as a result of which an arc can form in the area of the contacts between the switch and the rack, which contacts would normally be in the form of laminate blocks. Arcs can in turn lead to irreversible destruction of the switch and of the switchgear assembly overall.

SUMMARY

At least one embodiment of the invention specifies a switch which can be inserted into a switch holding device and remains positioned securely there even in the event of an overcurrent situation.

According to at least one embodiment of the invention, a switch is disclosed. Advantageous refinements of the switch according to the invention are specified in dependent claims.

At least one embodiment of the invention accordingly provides for the switch to have a locking device which, in the event of an overcurrent, moves a locking element of the locking device to a position which mechanically locks the switch in the switch holding device.

One major advantage of the switch according to at least one embodiment of the invention is that its locking device does not impede fitting of the switch in the switch holding device, since the locking device provided according to at least one embodiment of the invention moves a locking element to a position which mechanically locks the switch in the switch holding device only in the event of an overcurrent. When the switch is inserted, the locking element will therefore be located in an unlocked position, such that it does not impede the insertion or introduction of the switch into the switch holding device. Only in the event of an overcurrent situation is the locking element activated, locking the switch within the switch holding device.

It is considered to be particularly advantageous for the locking device to be designed such that, in the event of an overcurrent, it moves the locking element to the locked position and holds it there, and otherwise moves the locking element back to an unlocked position—preferably automatically by the force of gravity or on the basis of a resetting spring force. In this refinement, the locking element assumes its locked position only when an overcurrent situation occurs; before an overcurrent situation such as this and after the overcurrent situation has ended, the locking element returns to its unlocked position, thus allowing the switch to be removed easily from the switch holding device again—for example for maintenance purposes—without such removal being blocked by the locking element.

The locking device preferably operates electromagnetically using the electromagnetic field which is produced by a current flowing through the switch.

According to one embodiment of the switch, the locking device comprises a yoke and a moving armature element which, in the event of an overcurrent, is moved in the direction of the yoke by the magnetic force caused by the overcurrent, with the armature element itself forming the locking element or being connected indirectly or directly to it. A yoke and an armature element which moves with respect to it allow an overcurrent to be detected, and a movement of the locking element to be brought about, in a very simple manner, specifically because only a relatively small number of parts need to interact.

Particularly preferably, the yoke and the armature element are composed of a material which can be magnetized, in order to allow a magnetic flux, which is required for movement of the armature element, to be guided well magnetically in the event of an overcurrent.

Furthermore, it is considered to be particularly advantageous for the switch to have a conductor element which conducts the current to be switched and is arranged between the yoke and the armature element such that a current flowing through the conductor element causes a magnetic flux around the conductor element in the magnetic circuit formed by the yoke and the armature element. This arrangement allows an overcurrent situation to be detected in a high space-saving and therefore advantageous manner, specifically because the current to be switched by the switch is passed through directly between the yoke and the armature element.

Preferably, the conductor element is passed through an opening, which is formed by the yoke and the armature element.

With respect to a space-saving arrangement of the components, it is considered to be advantageous for the longitudinal direction of the conductor element to be aligned at right angles to the opening area which is bounded by the yoke and the armature element.

With respect to a simple mechanical design, it is considered to be advantageous for the armature element to be formed by a hinged armature which is mounted such that it can pivot, or to also comprise such a hinged armature. The hinged armature is preferably arranged such that the force of gravity always folds it to a position in which the switch and the switch holding device are unlocked.

Force transmission between the locking element and the armature element can be ensured, for example, by a connecting element which indirectly or directly mechanically connects the locking element and the armature element to one another. A connecting element such as this is preferably composed of non-conductive material, preferably plastic, in order to prevent capacitive coupling with the electrically conductive components of the electrical switch, in particular the conductor element which is arranged between the yoke and the armature element.

With respect to the housing being particularly highly robust, it is considered to be advantageous for the housing rear face of the switch to be formed by a rear-face section of a rear housing element of the switch housing and by a rear supporting plate, which is mounted on the rear-face section of the rear housing element.

In a "double-shell" embodiment of the housing rear face such as this, it is considered to be advantageous for the connecting element to be arranged at least in places between the rear-face section of the rear housing element and the rear supporting plate. An embodiment such as this prevents the connecting element resulting in an additional space requirement outside the switch housing.

With respect to good isolation of the switch housing from the current-carrying parts, it is considered to be advantageous for both the rear housing element and the rear supporting plate to be composed of a non-conductive material, for example a plastic material.

With respect to suitable guidance of the connecting element, it is considered to be advantageous for the rear housing element to have a slot on its rear-face section, in which slot the connecting element is guided at least in places such that it can move. In this embodiment, the connecting element is therefore located in the slot between the rear-face section of the rear housing element and the rear supporting plate, which closes the switch housing on the outside.

Furthermore, at least one embodiment of the invention relates to an arrangement having a switch holding device and an electrical switch, as described above, with the switch being inserted into the switch holding device along a predetermined insertion direction.

With respect to the advantages of the arrangement according to at least one embodiment of the invention, reference is made to the above statements in conjunction with the switch according to at least one embodiment of the invention, since the advantages of the arrangement according to the invention correspond essentially to those of the switch according to at least one embodiment of the invention.

It is considered to be advantageous if, in the event of an overcurrent, the locking element of the switch moves to a position which mechanically locks the switch in the switch holding device and in which the locking element is located—seen along the insertion direction—behind a frame element of the switch holding device. This results in the switch being locked in a particularly simple and efficient manner within the switch holding device.

By way of example, the connecting element may be formed by a bolt which, in the event of an overcurrent, is pushed (seen along the insertion direction) along its bolt longitudinal direction behind the frame element of the switch holding device.

BRIEF DESCRIPTION OF THE DRAWINGS

The invention will be explained in more detail in the following text with reference to example embodiments; in this case, by way of example.

For the sake of clarity, the same reference symbols are always used for comparable or identical components in the figures.

Figure 1:
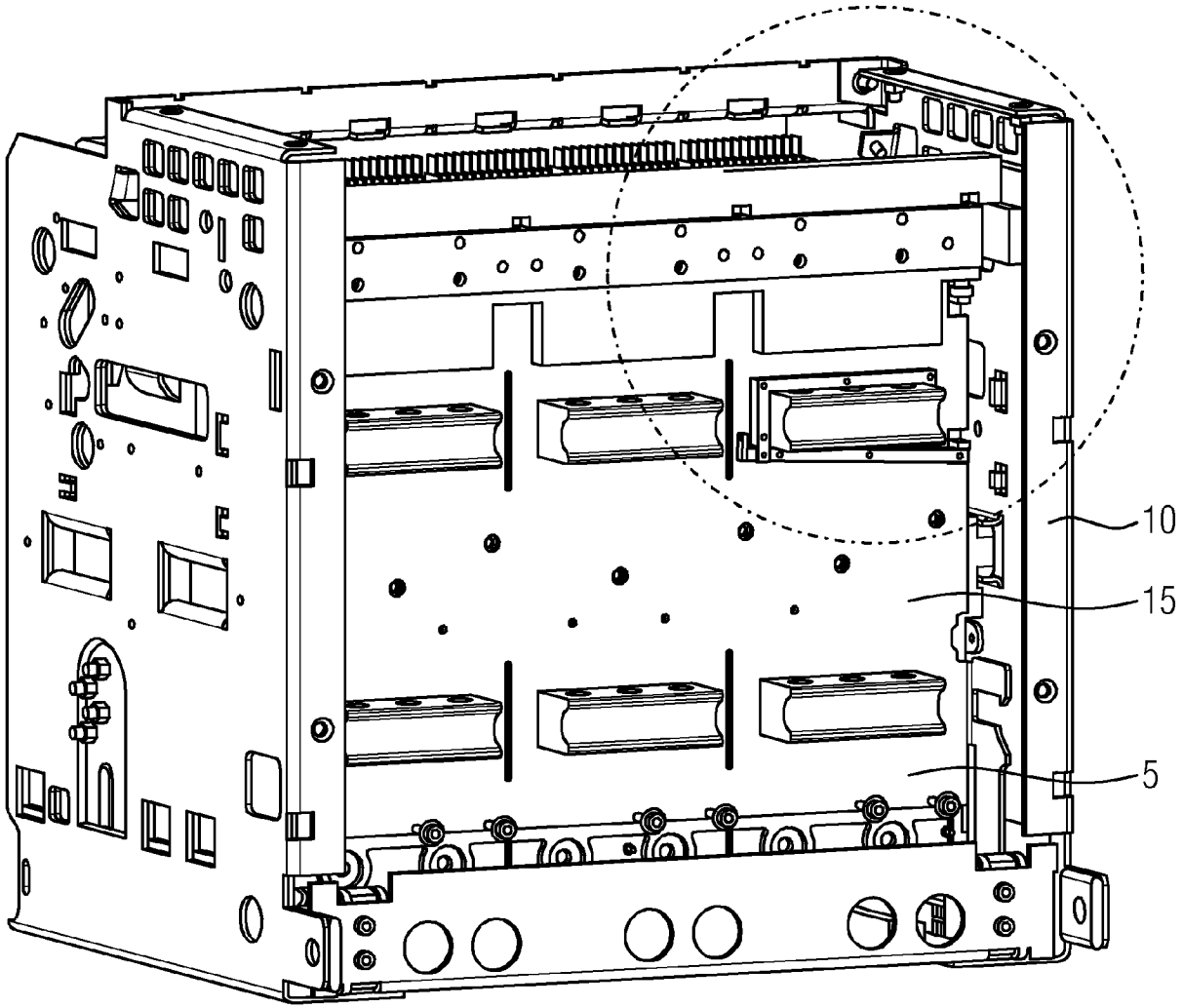
FIG. 1 shows an arrangement having a switch holding device and one example embodiment of a switch according to the invention in the form of a three-dimensional illustration from the rear.

It should be noted that these Figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. For example, the relative thicknesses and positioning of molecules, layers, regions and/or structural elements may be reduced or exaggerated for clarity. The use of similar or identical reference numbers in the various drawings is intended to indicate the presence of a similar or identical element or feature.

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

In the following description, illustrative embodiments may be described with reference to acts and symbolic representations of operations (e.g., in the form of flowcharts) that may be implemented as program modules or functional processes include routines, programs, objects, components, data structures, etc., that perform particular tasks or implement particular abstract data types and may be implemented using existing hardware at existing network elements. Such existing hardware may include one or more Central Processing Units (CPUs), digital signal processors (DSPs), application-specific-integrated-circuits, field programmable gate arrays (FPGAs) computers or the like.

Note also that the software implemented aspects of the example embodiments may be typically encoded on some form of program storage medium or implemented over some type of transmission medium. The program storage medium (e.g., non-transitory storage medium) may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The example embodiments not limited by these aspects of any given implementation.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows an arrangement having a circuit breaker 5 which is inserted into a switch holding device in the form of a rack 10. The housing rear face of the circuit breaker 5 is identified by the reference symbol 15 in FIG. 1.

Figure 2:
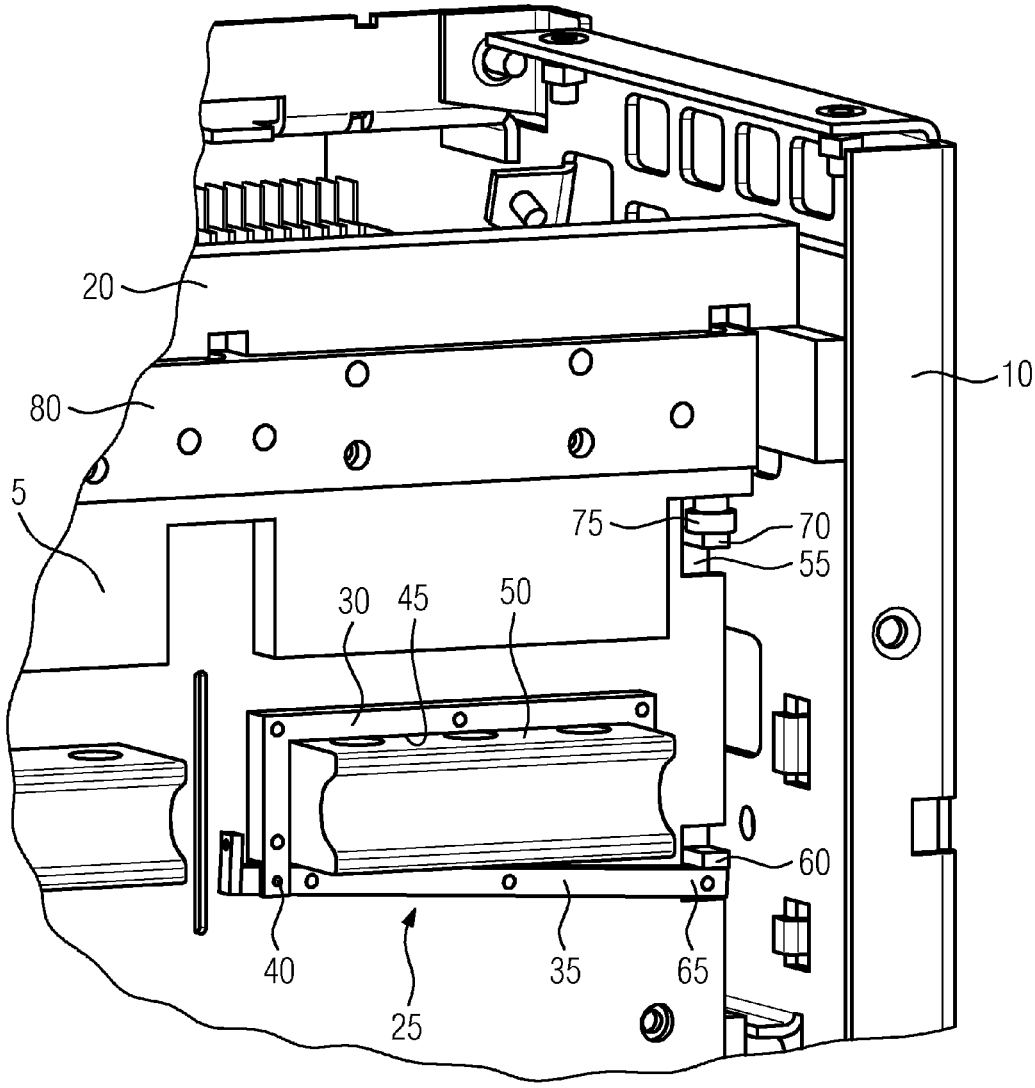
FIG. 2 shows the arrangement as shown in FIG. 1, in the form of a three-dimensional detail illustration.

FIG. 2 shows the arrangement as shown in FIG. 1 in more detail. As can be seen, the rack 10 has a frame element 20 which interacts with a locking device 25 of the circuit breaker 5.

The locking device 25 of the circuit breaker 5 comprises a magnetic yoke 30, which has an approximately U-shaped cross section. An armature element in the form of a hinged armature 35 of the locking device 25 interacts with the magnetic yoke 30. The hinged armature 35 is mounted on the magnetic yoke 30 such that it can pivot about a pivoting axis 40. The yoke 30 and the hinged armature 35 together form an opening 45 through which a conductor element 50 is passed. The conductor element 50 is used to carry the electric current to be switched by the circuit breaker 5. The arrangement of the conductor element 50 is preferably chosen such that it passes through the opening 45 at least approximately at right angles.

If the circuit breaker 5 is a polyphase switch, then the conductor element 50 is preferably suitable for carrying one of the phases of the polyphase current.

Furthermore, FIG. 2 shows a connecting element 55, which is mounted such that it can move along its longitudinal axis. A lower end 60 of the connecting element rests on the outer lever end 65 of the hinged armature 35.

The upper end 70 of the connecting element 55 in FIG. 2 is connected to a locking element 75 in the form of a bolt. The locking element 75 is guided such that it can move in an aperture hole in a lateral strut 80, such that its upper end can be pushed upwards through the lateral strut 80 and can thus be positioned behind the frame element 20, seen in the insertion direction.

FIG. 3 once again shows the arrangement as shown in FIGS. 1 and 2, in a view from the rear. The figure shows the housing rear face 15 of the circuit breaker 5 as well as the locking device 25, which comprises the magnetic yoke 30, the hinged armature 35, the connecting element 55 and the locking element 75.

Furthermore, the figure shows that the lateral strut 80, which is mounted fixed on the housing rear face 15 of the circuit breaker 5, has an aperture hole 81 through which the locking element 75 can be pushed.

Figure 3:
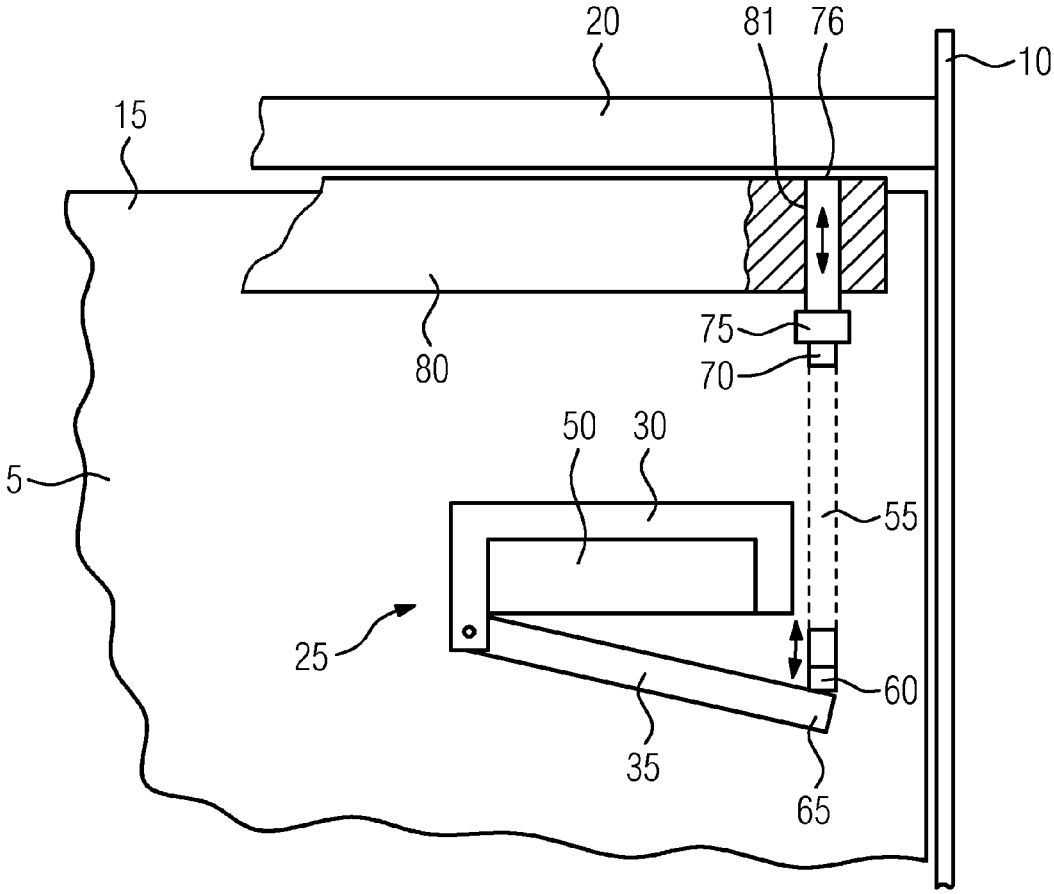
FIG. 3 shows the arrangement as shown in FIG. 1, in a view from the rear.

The arrangement as shown in FIGS. 1 to 3 operates as follows:

If an overcurrent flows through the conductor element 50 of the circuit breaker 5, that is to say a current which is greater than a predetermined current threshold, then the magnetic flux flowing in the magnetic yoke 30 and in the hinged armature 35 becomes sufficiently great that the magnetic force is sufficient to pivot the hinged armature 35 upward about the pivoting axis 40, in the counterclockwise direction and against the force of gravity. This pivoting movement closes the magnetic circuit formed by the yoke 30 and the hinged armature 35.

During the pivoting movement of the hinged armature 35 in the counterclockwise direction, the lever end 65 of the hinged armature 35 will push the lower end 60 of the connecting element 55 upward, as a result of which the upper end 70 of the connecting element 55 will also push the locking element 75 upward.

The upward movement of the locking element 75 results in the upper end 76 of the locking element—seen in the insertion direction of the circuit breaker 5—being positioned behind the frame element 20 of the rack 10, thus preventing the circuit breaker 5 from being pulled out of the rack 10.

The upward movement of the locking element 75 in the event of an overload situation, to be precise in the event of an overcurrent, will take place more quickly, because of the low mass of the locking device 25, than an overall movement of the circuit breaker 5 caused by the magnetic force. In other words, therefore, the locking device 25 will block or lock the circuit breaker 5 within the rack 10 more quickly than the circuit breaker 5 can be moved out of the rack 10 by the magnetic force which occurs.

FIG. 4 once again shows the arrangement as shown in FIGS. 1 to 3, in the form of a side view. This figure once again shows the locking device 25 with the magnetic yoke 30, the hinged armature 35, the connecting element 55 and the locking element 75.

The figure also shows that the housing rear face 15 of the circuit breaker 5 is formed by a rear-face section 100 of a rear housing element 105 of the circuit breaker 5 and by a rear supporting plate 110, which is mounted on the rear-face section 100 of the rear housing element 105.

Figure 4:
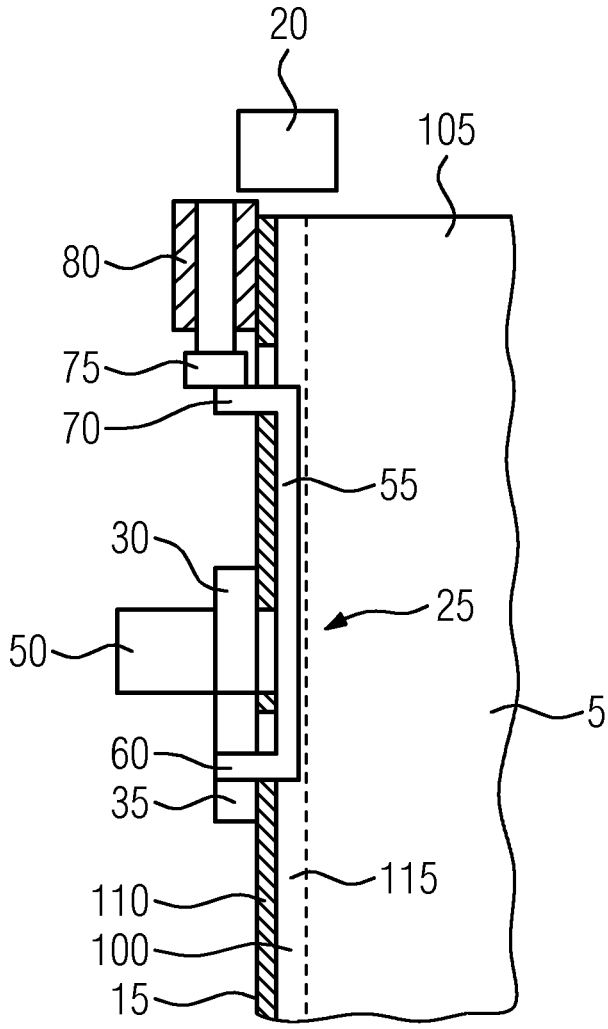
FIG. 4 shows the arrangement as shown in FIG. 1, in a view from the side.

Furthermore, FIG. 4 shows a slot 115, which is provided in the rear-face section 100 of the rear housing element 105. The connecting element 55 is guided such that it can move in this slot 115.

In other words, the connecting element 55 is arranged in places between the rear housing element 105 and the rear supporting plate 110.

One major advantage of the circuit breaker 5 as shown in FIGS. 1 to 4 is that the locking device 25 is active only in the event of an overload situation. Only if the current flowing through the opening 45 in the magnetic circuit formed by the magnetic yoke 30 and the hinged armature 35 becomes too great will the hinged armature 35 move upward against the force of gravity, thus moving the connecting element 55, and therefore the locking element 75, to a locked position. Before an overload situation and after an overload situation such as this has decayed, the hinged armature 35 will once again move to the lower pivot position, as illustrated in the figures, in which the locking element 75 does not engage with the frame element 20 of the rack 10.

The locking device 25 therefore allows the circuit breaker 5 to be fitted very easily in the rack 10. As explained, this is because, during insertion of the circuit breaker 5, the locking device 25 is automatically inactive and does not impede insertion of the circuit breaker 5 into the rack 10. In addition, the circuit breaker 5 can be removed from the rack 10 at any time, except in an overcurrent situation. This is because, in a situation such as this, the hinged armature 35 will be located in its "folded down" position, as a result of which the locking element 75 is not engaged with the rack.

Insertion, for example by "cranking in", or removal, for example by "cranking out", of the circuit breaker 5 respectively into and out of the rack 10 is therefore possible at any time, without being impeded by the locking device 25.

By way of example, FIGS. 1 to 4 show only a single locking device 25. If this is a polyphase circuit breaker, then it is considered to be advantageous for there to be two or more locking devices 25, for example one per phase.

In the case of a three-phase switch, it is also possible to provide only two locking devices 25, for example one for the first phase and one for the third phase.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE SYMBOLS

5 Circuit breaker
10 Rack
15 Housing rear face
20 Frame element
25 Locking device
30 Yoke
35 Hinged armature
40 Pivoting axis
45 Opening
50 Conductor element
55 Connecting element
60 Lower end
65 Lever end
70 Upper end
75 Locking element
76 Upper end
80 Lateral strut
81 Aperture hole
100 Rear-face section
105 Housing element
110 Supporting plate
115 Slot

What is claimed is:

1. An electrical switch for switching an electric current, the switch being insertable into a switch holding device, the switch comprising:

a locking device configured to, in the event of an overcurrent, move a locking element of the locking device to a position which mechanically locks the switch in the switch holding device, the locking device including, a yoke, and a moving armature element configured to, in the event of an overcurrent, be moved in the direction of the yoke by the magnetic force caused by the overcurrent, the moving armature element forming the locking element or being connected indirectly or directly to the locking element; and a conductor element, configured to conduct the current to be switched and arranged between the yoke and the armature element such that a current flowing through the conductor element causes a magnetic flux around the conductor element in the magnetic circuit formed by the yoke and the armature element.

2. The electrical switch as claimed in claim 1, wherein the locking device is configured to, in the event of an overcurrent, move the locking element to the locked position and hold the locking element in the locked position, and to otherwise move the locking element back to an unlocked position.

3. The electrical switch as claimed in claim 1, wherein the conductor element is passed through an opening, formed by the yoke and the armature element.

4. An electrical switch for switching an electric current, the switch being insertable into a switch holding device, the switch comprising:

a locking device configured to, in the event of an overcurrent, move a locking element of the locking device to a position which mechanically locks the switch in the switch holding device the locking device including, a yoke, and a moving armature element configured to, in the event of an overcurrent, be moved in the direction of the yoke by the magnetic force caused by the overcurrent, the moving armature element forming the locking element or being connected indirectly or directly to the locking element; wherein the armature element is a hinged armature which is mounted such that the armature element is pivotable.

5. An electrical switch for switching an electric current, the switch being insertable into a switch holding device, the switch comprising:

a locking device configured to, in the event of an overcurrent, move a locking element of the locking device to a position which mechanically locks the switch in the switch holding device, wherein the locking device includes, a yoke, and a moving armature element configured to, in the event of an overcurrent, be moved in the direction of the yoke by the magnetic force caused by the overcurrent, the moving armature element forming the locking element or being connected indirectly or directly to the locking element, wherein, the locking element and the armature element are indirectly or directly mechanically connected to one another by a connecting element, a housing rear face of the switch is formed by a rear-face section of a rear housing element of the switch housing and by a rear supporting plate, mounted on the rear-face section of the rear housing element, and the connecting element is arranged at least in places between the rear-face section of the rear housing element and the rear supporting plate.

6. The electrical switch as claimed in claim 5, wherein the rear housing element includes a slot on its rear-face section, the connecting element being guidable at least in places of the slot such that the connecting element is movable.

7. An arrangement comprising:

an electrical switch as claimed in claim 1, the switch being inserted into the switch holding device along a predetermined insertion direction, wherein, in the event of an overcurrent, the locking element moves to a position which mechanically locks the switch in the switch holding device and wherein the locking element is located, along the insertion direction, behind a frame element of the switch holding device, thus blocking outward movement of the switch.

8. The electrical switch as claimed in claim 1, wherein the armature element is a hinged armature which is mounted such that the armature element is pivotable.

9. The electrical switch as claimed in claim 3, wherein the armature element is a hinged armature which is mounted such that the armature element is pivotable.

10. The electrical switch as claimed in claim 1, wherein the locking element and the armature element are indirectly or directly mechanically connected to one another by a connecting element.

11. The electrical switch as claimed in claim 3, wherein the locking element and the armature element are indirectly or directly mechanically connected to one another by a connecting element.

12. An arrangement comprising:

an electrical switch as claimed in claim 2, the switch being inserted into the switch holding device along a predetermined insertion direction, wherein, in the event of an overcurrent, the locking element moves to a position which mechanically locks the switch in the switch holding device and wherein the locking element is located, along the insertion direction, behind a frame element of the switch holding device, thus blocking outward movement of the switch.

* * * * *